US010522335B2

(12) United States Patent
Kubo

(10) Patent No.: US 10,522,335 B2
(45) Date of Patent: Dec. 31, 2019

(54) MASS SPECTROMETRY DATA PROCESSING APPARATUS, MASS SPECTROMETRY SYSTEM, AND METHOD FOR PROCESSING MASS SPECTROMETRY DATA

(71) Applicant: JEOL Ltd., Tokyo (JP)

(72) Inventor: Ayumi Kubo, Tokyo (JP)

(73) Assignee: JEOL Ltd., Tokyo (JP)

( * ) Notice: Subject to any disclaimer, the term of this patent is extended or adjusted under 35 U.S.C. 154(b) by 0 days.

(21) Appl. No.: 16/104,450

(22) Filed: Aug. 17, 2018

(65) Prior Publication Data

US 2019/0096646 A1 Mar. 28, 2019

(30) Foreign Application Priority Data

Aug. 21, 2017 (JP) ..... 2017-158915

(51) Int. Cl.

| | |
|---|---|
| ***H01J 49/36*** | (2006.01) |
| ***H01J 49/00*** | (2006.01) |
| ***H01J 49/26*** | (2006.01) |
| ***H01J 49/10*** | (2006.01) |
| ***H01J 49/04*** | (2006.01) |

(52) U.S. Cl.

CPC ..... *H01J 49/0036* (2013.01); *H01J 49/0031* (2013.01); *H01J 49/04* (2013.01); *H01J 49/10* (2013.01); *H01J 49/26* (2013.01)

(58) Field of Classification Search

CPC ..... H01J 49/0036; H01J 49/04; H01J 49/10; H01J 49/26; H01J 49/0031

USPC ..... 250/281, 282; 702/22–24, 27, 28

See application file for complete search history.

(56) References Cited

U.S. PATENT DOCUMENTS 5,352,891 A * 10/1994 Monnig ..... H01J 49/0036 250/282

8,417,466 B2 * 4/2013 Yamaguchi ..... G01N 27/62 702/23

FOREIGN PATENT DOCUMENTS

JP 2016061670 A 4/2016

* cited by examiner

*Primary Examiner* — Michael Maskell

(74) *Attorney, Agent, or Firm* — The Webb Law Firm

(57) ABSTRACT

A mass spectrometry data processing apparatus includes a data processing part and a calculation part. The calculation part calculates differences in mass among all pieces of the peak data from the peak list, calculates an intensity ratio that is a ratio of intensity between two pieces of the peak data used in calculating the difference, and generates difference-intensity ratio data. Further, the calculation part retrieves difference-intensity ratio data having the difference included in a section, calculates a sum of the intensity ratio of the retrieved difference-intensity ratio data, and calculates difference-intensity ratio distribution data.

14 Claims, 23 Drawing Sheets

FIG. 4

| SAMPLE | REPEATED STRUCTURE | TERMINAL STRUCTURE | POLYMERIZATION DEGREE | MAXIMUM INTENSITY (I) | MASS-TO-CHARGE RATIO (m/z) |
|---|---|---|---|---|---|
| A | C2H4O | H2ONa | 15-29 | 100 | 44.02567*n + 40.99979 |
| B | C2H4O | H2Na | 17-31 | 5 | 44.02567*n + 25.00487 |
| C | C3H6O | C2H4ONa | 11-23 | 10 | 58.04132*n + 67.01544 |

FIG. 6

| MASS-TO-CHARGE RATIO (m/z) | PEAK INTENSITY (I) |
|---|---|
| $m_1$ | $I_1$ |
| $m_2$ | $I_2$ |
| $m_3$ | $I_3$ |
| $m_4$ | $I_4$ |
| ... | ... |
| $m_m$ | $I_m$ |
| ... | ... |
| $m_n$ | $I_n$ |
| ... | ... |

FIG. 8

| DIFFERENCE d | INTENSITY RATIO (WEIGHT) y |
|---|---|
| $d_1(m_2-m_1)$ | $y_1(I_2/I_1)$ |
| $d_2(m_3-m_2)$ | $y_2(I_2/I_3)$ |
| $d_3(m_3-m_1)$ | $y_3(I_1/I_3)$ |
| $d_4(m_4-m_3)$ | $y_4(I_4/I_3)$ |
| $d_5(m_4-m_2)$ | $y_5(I_4/I_2)$ |
| $d_6(m_4-m_1)$ | $y_6(I_4/I_1)$ |
| ... | ... |
| $d_m(m_n-m_m)$ | $y_m(I_m/I_n)$ |
| ... | ... |

FIG. 9

| SECTION (DIFFERENCE d) | | SUM OF INTENSITY RATIO (WEIGHT) y |
|---|---|---|
| 20.00 | 20.01 | 0 |
| 20.01 | 20.02 | 0.01 |
| ··· | ··· | ··· |
| 28.03 | 28.04 | 2.41 |
| ··· | ··· | ··· |
| 44.02 | 44.03 | 20.85 |
| ··· | ··· | ··· |
| 58.04 | 58.05 | 8.97 |
| ··· | ··· | ··· |

FIG. 12

| MASS-TO-CHARGE RATIO (m/z) | PEAK INTENSITY (I) | POLYMERIZATION DEGREE (n) | RESIDUAL ERROR (e) |
|---|---|---|---|
| $m_1$ | $I_1$ | $n_1$ | $e_1$ |
| $m_2$ | $I_2$ | $n_2$ | $e_2$ |
| $m_3$ | $I_3$ | $n_3$ | $e_3$ |
| $m_4$ | $I_4$ | $n_4$ | $e_4$ |
| ××× | ××× | ××× | ××× |
| $m_m$ | $I_m$ | $n_m$ | $e_m$ |
| ××× | ××× | ××× | ××× |
| $m_n$ | $I_n$ | $n_n$ | $e_n$ |
| ××× | ××× | ××× | ××× |

FIG. 13

| SECTION (RESIDUAL ERROR e) | | FREQUENCY (APPEARANCE FREQUENCY) |
|---|---|---|
| 0.00 | 0.01 | 0 |
| 0.01 | 0.02 | 0 |
| ··· | ··· | ··· |
| 15.99 | 16.00 | 3 |
| ··· | ··· | ··· |
| 24.99 | 25.00 | 11 |
| ··· | ··· | ··· |
| 32.01 | 32.02 | 5 |
| ··· | ··· | ··· |
| 40.98 | 40.99 | 11 |
| ··· | ··· | ··· |

FIG. 15A

| MASS-TO-CHARGE RATIO (m/z) | PEAK INTENSITY (I) | POLYMERIZATION DEGREE (n) | RESIDUAL ERROR (e) |
|---|---|---|---|
| 701.385 | 24.9 | 15 | 40.995 |
| 745.411 | 41.1 | 16 | 40.995 |
| 789.436 | 60.7 | 17 | 40.994 |
| 833.462 | 80.1 | 18 | 40.994 |
| 877.488 | 94.6 | 19 | 40.994 |
| 921.513 | 100.0 | 20 | 40.993 |
| 965.539 | 94.6 | 21 | 40.993 |
| 1009.565 | 80.1 | 22 | 40.993 |
| 1053.590 | 60.7 | 23 | 40.992 |
| 1097.616 | 41.1 | 24 | 40.992 |
| 1141.642 | 24.9 | 25 | 40.992 |
| 1185.667 | 13.5 | 26 | 40.991 |
| 1229.693 | 6.6 | 27 | 40.991 |
| 1273.719 | 2.9 | 28 | 40.991 |
| 1317.744 | 1.1 | 29 | 40.990 |

FIG. 15B

| MASS-TO-CHARGE RATIO (m/z) | PEAK INTENSITY (I) | POLYMERIZATION DEGREE (n) | RESIDUAL ERROR (e) |
|---|---|---|---|
| 773.441 | 1.1 | 17 | 24.999 |
| 817.467 | 1.6 | 18 | 24.999 |
| 861.493 | 2.3 | 19 | 24.999 |
| 905.518 | 3.0 | 20 | 24.998 |
| 949.544 | 3.8 | 21 | 24.998 |
| 993.570 | 4.4 | 22 | 24.998 |
| 1037.595 | 4.8 | 23 | 24.997 |
| 1081.621 | 5.0 | 24 | 24.997 |
| 1125.647 | 4.8 | 25 | 24.997 |
| 1169.672 | 4.4 | 26 | 24.996 |
| 1213.698 | 3.8 | 27 | 24.996 |
| 1257.724 | 3.0 | 28 | 24.996 |
| 1301.749 | 2.3 | 29 | 24.995 |
| 1345.775 | 1.6 | 30 | 24.995 |
| 1389.801 | 1.1 | 31 | 24.995 |

FIG. 18

| MASS-TO-CHARGE RATIO (m/z) | PEAK INTENSITY (I) | POLYMERIZATION DEGREE (n) | RESIDUAL ERROR (e) |
|---|---|---|---|
| 705.470 | 1.4 | 12 | 8.974 |
| 763.511 | 2.5 | 13 | 8.974 |
| 821.553 | 4.1 | 14 | 8.974 |
| 879.594 | 6.1 | 15 | 8.974 |
| 937.635 | 8.0 | 16 | 8.974 |
| 995.677 | 9.5 | 17 | 8.974 |
| 1053.718 | 10.0 | 18 | 8.974 |
| 1111.759 | 9.5 | 19 | 8.975 |
| 1169.801 | 8.0 | 20 | 8.975 |
| 1227.842 | 6.1 | 21 | 8.975 |
| 1285.883 | 4.1 | 22 | 8.975 |
| 1343.924 | 2.5 | 23 | 8.975 |
| 1401.966 | 1.4 | 24 | 8.975 |

SECTION AGGREGATE

PEAK DETECTION

MASS SPECTROMETRY DATA PROCESSING APPARATUS, MASS SPECTROMETRY SYSTEM, AND METHOD FOR PROCESSING MASS SPECTROMETRY DATA

CROSS-REFERENCE TO RELATED APPLICATION

This application claims priority to Japanese Patent Application No. 2017-158915 filed Aug. 21, 2017, the disclosure of which is hereby incorporated in its entirety by reference.

BACKGROUND OF THE INVENTION

Field of the Invention

The present invention relates to a mass spectrometry data processing apparatus, a mass spectrometry system, and a method for processing mass spectrometry data used for analyzing an introduced sample.

Description of Related Art

Conventionally, the mass spectrometry data processing apparatus performs various data processing by using mass spectrum data measured by a mass spectrometer to perform analysis of the introduced sample (for example, refer to JP 2016-61670 A).

FIG. 23A and FIG. 23B are diagrams showing analysis results of mass spectrum data and variance information of polymerization degree of one type of polymer having a conventional repeated structure, respectively.

FIG. 23A shows a mass-to-charge ratio (m/z value) on the horizontal axis and an intensity on the vertical axis.

As shown in FIG. 23A, in a case of one type of polymer, a peak interval of the mass spectrum data is constant. Therefore, a repeated structure of polymer can be analyzed from the peak interval. Further, from the appearance of entire peak, as shown in FIG. 23B, variance information of polymerization degree of polymer can be read.

SUMMARY OF THE INVENTION

However, mass spectrum data of complex sample containing a plurality of polymers shows many peaks due to difference in the polymerization degree and is complex. Therefore, it has been difficult to analyze a repeated structure or the like of a specific sample.

An object of the present invention is, in consideration of the above problem, to provide a mass spectrometry data processing apparatus, a mass spectrometry system, and a method for processing mass spectrometry data capable of analyzing a repeated structure or the like of a sample from complex mass spectrum data in which many peaks are observed.

In order to solve the above problem and achieve the object of the present invention, a mass spectrometry data processing apparatus of the present invention includes a data processing part that extracts a plurality of peaks from mass spectrum data and generates a peak list including peak data in which a mass and an intensity of each of the peaks are registered. The data processing part has a calculation part that calculates differences in mass among all pieces of the peak data from the peak list. The calculation part calculates an intensity ratio that is a ratio of intensity between two pieces of the peak data used in calculating the difference for each of the calculated differences, and generates difference-intensity ratio data including the difference and the intensity ratio. In addition, the calculation part retrieves difference-intensity ratio data having the difference included in a section of a preset difference from the difference-intensity ratio data, calculates a sum of the intensity ratio of the retrieved difference-intensity ratio data, and calculates difference-intensity ratio distribution data including a section of the difference and a sum of the intensity ratio.

Further, a mass spectrometry system of the present invention includes a mass spectrometer that performs mass spectrometry of a sample and generates mass spectrum data and a mass spectrometry data processing apparatus that acquires the mass spectrum data from the mass spectrometer. As a mass spectrometry data processing apparatus, the above-described mass spectrometry data processing apparatus is used.

Furthermore, the method for processing mass spectrometry data of the present invention includes the steps shown in (1) to (3) described below.

(1) the step of extracting a plurality of peaks from mass spectrum data and generating a peak list including peak data in which a mass and an intensity of each of the peaks are registered.

(2) the step of calculating differences in mass among all pieces of the peak data from the peak list, calculating an intensity ratio that is a ratio of intensity between two pieces of the peak data used in calculating the difference for each of the calculated differences, and generating difference-intensity ratio data including the difference and the intensity ratio.

(3) the step of retrieving difference-intensity ratio data having the difference included in a section of a preset difference from the difference-intensity ratio data, calculating a sum of the intensity ratio of the retrieved difference-intensity ratio data, and calculating difference-intensity ratio distribution data including a section of the difference and a sum of the intensity ratio.

According to the mass spectrometry data processing apparatus, mass spectrometry system, and method for processing mass spectrometry data of the present invention, it is possible to analyze a repeated structure or the like of a sample from complex mass spectrum data in which many peaks are observed.

BRIEF DESCRIPTION OF THE DRAWINGS

FIG. 4 is a diagram showing data of a sample used in the method for processing mass spectrometry data according to the first embodiment;

FIG. 6 is a peak list generated from the mass spectrum data shown in FIGS. 5A to 5E;

FIG. 8 is a table showing a difference list in the method for processing mass spectrometry data according to the first embodiment;

FIG. 9 is a difference-intensity ratio sum distribution table in the method for processing mass spectrometry data according to the first embodiment;

FIG. 12 is a peak list to which a residual error and a polymerization degree are added in the method for processing mass spectrometry data according to the first embodiment;

FIG. 13 is a residual error frequency distribution table in the method for processing mass spectrometry data according to the first embodiment;

FIGS. 15A and 15B are peak lists extracted by using the residual error frequency distribution table shown in FIG. 13 or the residual error histogram shown in FIG. 14;

FIG. 18 is a peak list extracted by using the residual error histogram shown in FIG. 17;

DESCRIPTION OF THE INVENTION

Embodiments of a mass spectrometry data processing apparatus, a mass spectrometry system, and a method for processing mass spectrometry data of the present invention will be described below with reference to FIGS. 1 to 22. Note that, common members in each drawing are attached with the same code. In addition, explanation will be given in the following order, but the present invention is not necessarily limited to the following mode.

1. Configuration of Mass Spectrometry System

First, a mass spectrometry system according to an embodiment (hereinafter, referred to as "present example") of the present invention will be described with reference to FIG. 1 and FIG. 2.

Figure 1:
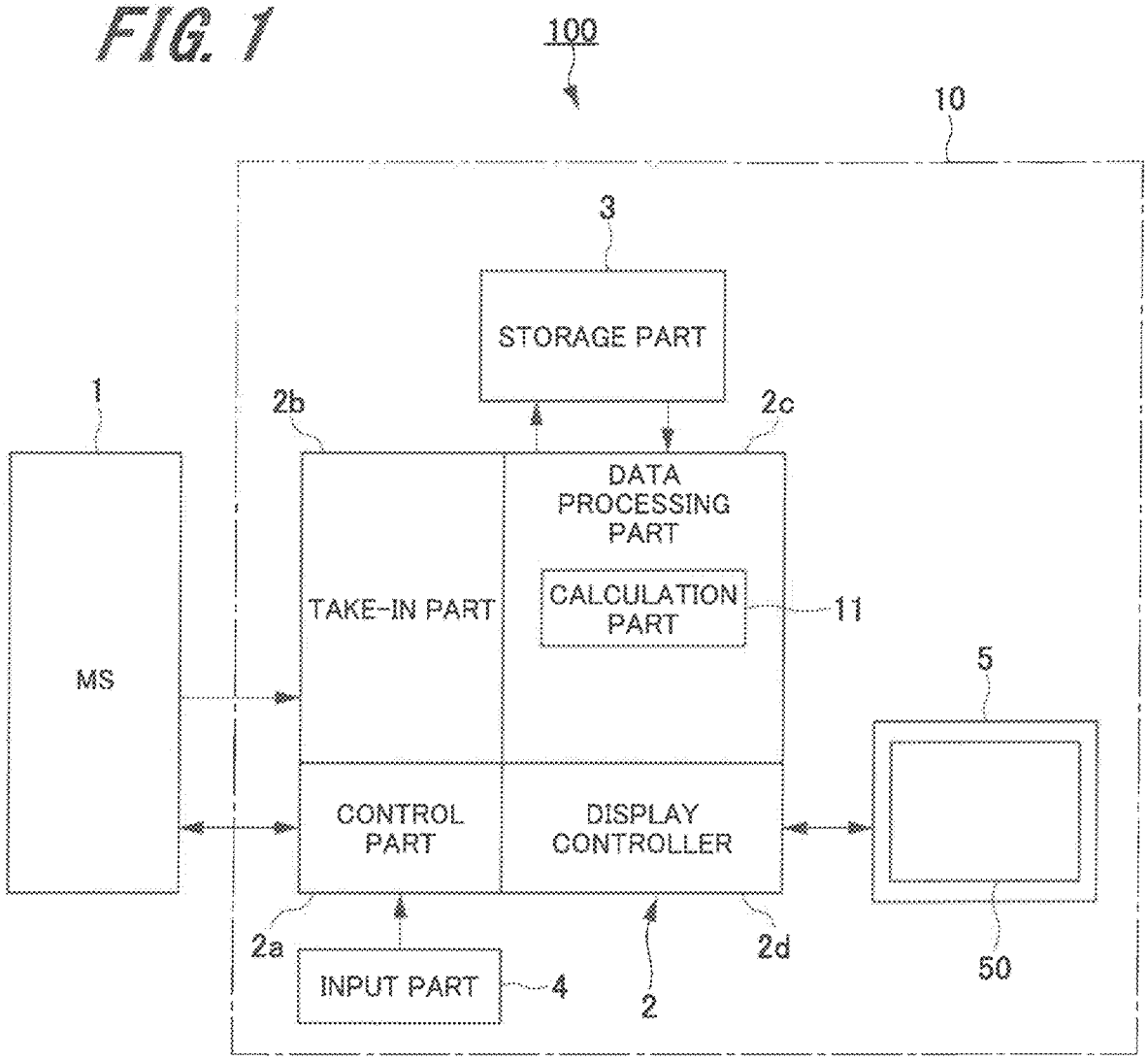
FIG. 1 is a schematic configuration diagram showing a mass spectrometry system according to an embodiment.
Figure 2:
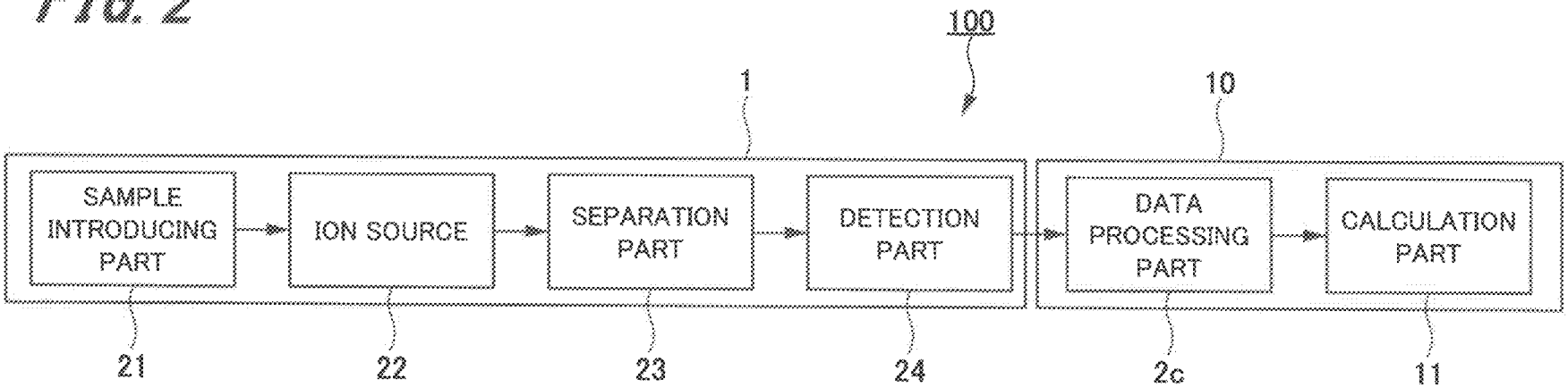
FIG. 2 is a block diagram showing a mass spectrometry system according to an embodiment.

FIG. 1 is a schematic configuration diagram showing a mass spectrometry system of the present example, and FIG. 2 is a block diagram showing the mass spectrometry system.

A mass spectrometry system 100 shown in FIG. 1 is a system used for analyzing an introduced sample. As shown in FIG. 1, the mass spectrometry system 100 includes a mass spectrometer (MS) 1 and a mass spectrometry data processing apparatus 10. The mass spectrometer 1 and the mass spectrometry data processing apparatus 10 are connected through a wireless or wired network (LAN (Local Area Network), the Internet, a dedicated line, or the like) and can mutually exchange data.

The mass spectrometer 1 is a device that ionizes the introduced sample, detects a detection intensity for each mass-to-charge ratio (m/z) of ion, and generates mass spectrum data. As shown in FIG. 2, the mass spectrometer 1 includes a sample introducing part 21 that introduces a sample, an ion source 22, a separation part 23, and a detection part 24.

The ion source 22 ionizes the sample introduced into the sample introducing part 21. As an ionization method by the ion source 22, an electron ionization (EI) method, a chemical ionization (CI) method, a fast atom bombardment (FAB) method, an electrospray ionization (ESI) method, an atmospheric pressure chemical ionization (APCI) method, a matrix-assisted laser desorption/ionization (MALDI) method, and the like, or other various ionization methods can be applied. Note that, the MALDI method is used as the ionization method of the ion source of the present example.

The separation part 23 separates ions generated in the ion source 22 according to mass. As the separation part 23, a magnetic field type, a quadrupole type, an ion trap type, a Fourier-transform ion-cyclotron resonance type, a flight time type, and the like, or combinations thereof, or other various types of mass separation parts can be applied. Note that, the flight time type is used as the mass separation part of the present example.

The detection part 24 detects an ion separated by the separation part 23. In addition, the detection part 24 converts a detection intensity of the detected ion into an analog signal and transmits it to a data processing part 2*c* of the mass spectrometry data processing apparatus 10 to be described below.

The mass spectrometry data processing apparatus 10 includes a controller 2, a storage part 3, an input part 4, and a display device 5. The controller 2 has a control part 2*a* that controls the mass spectrometer 1, a take-in part 2*b* that acquires mass spectrometry data from the mass spectrometer 1, a data processing part 2*c*, and a display controller 2*d* that controls the display device 5.

The control part 2*a* is connected with the input part 4. As the input part 4, for example, various input means, such as a keyboard and a switch, are applied. The take-in part 2*b* acquires mass spectrum data from the mass spectrometer 1. Then, the take-in part 2*b* transmits acquired mass spectrometry data to the data processing part 2*c*.

The data processing part 2*c* performs calculation processing on the acquired mass spectrometry data. The data processing part 2*c* performs calculation processing on the mass spectrometry data acquired by the take-in part 2*b* to calculate a repeated structure and a terminal structure of the introduced sample.

In addition, the data processing part 2*c* is provided with a search part and a narrowing part which are not shown. The search part estimates a composition, based on information on which a calculation part 11 has performed calculation processing, information input into the input part 4, and information stored in the storage part 3. The narrowing part performs narrowing processing on the composition searched by the search part, based on a preset condition. The narrowing part transmits a candidate of the narrowed composition to the display controller 2*d* and the storage part 3.

In addition, the display controller 2*d* performs processing for displaying data subjected to calculation processing by the data processing part 2*c*, the mass spectrometry data acquired by the take-in part 2*b*, or the like on the display device 5.

The storage part 3 stores various kinds of data transmitted from the controller 2 and an exact mass and the like of an atom used for estimating a composition as a mass-to-charge ratio (m/z value).

As the mass spectrometry data processing apparatus 10, a control device integrally provided with the mass spectrometer 1 may be applied, or an external portable information processing terminal, a PC (personal Computer), or the like may be applied.

2. Method for Processing Mass Spectrometry Data According to a First Embodiment

Next, a method for processing mass spectrometry data according to the first embodiment using the mass spectrometry system 100 having the above configuration will be described with reference to FIGS. 3 to 19.

Figure 3:
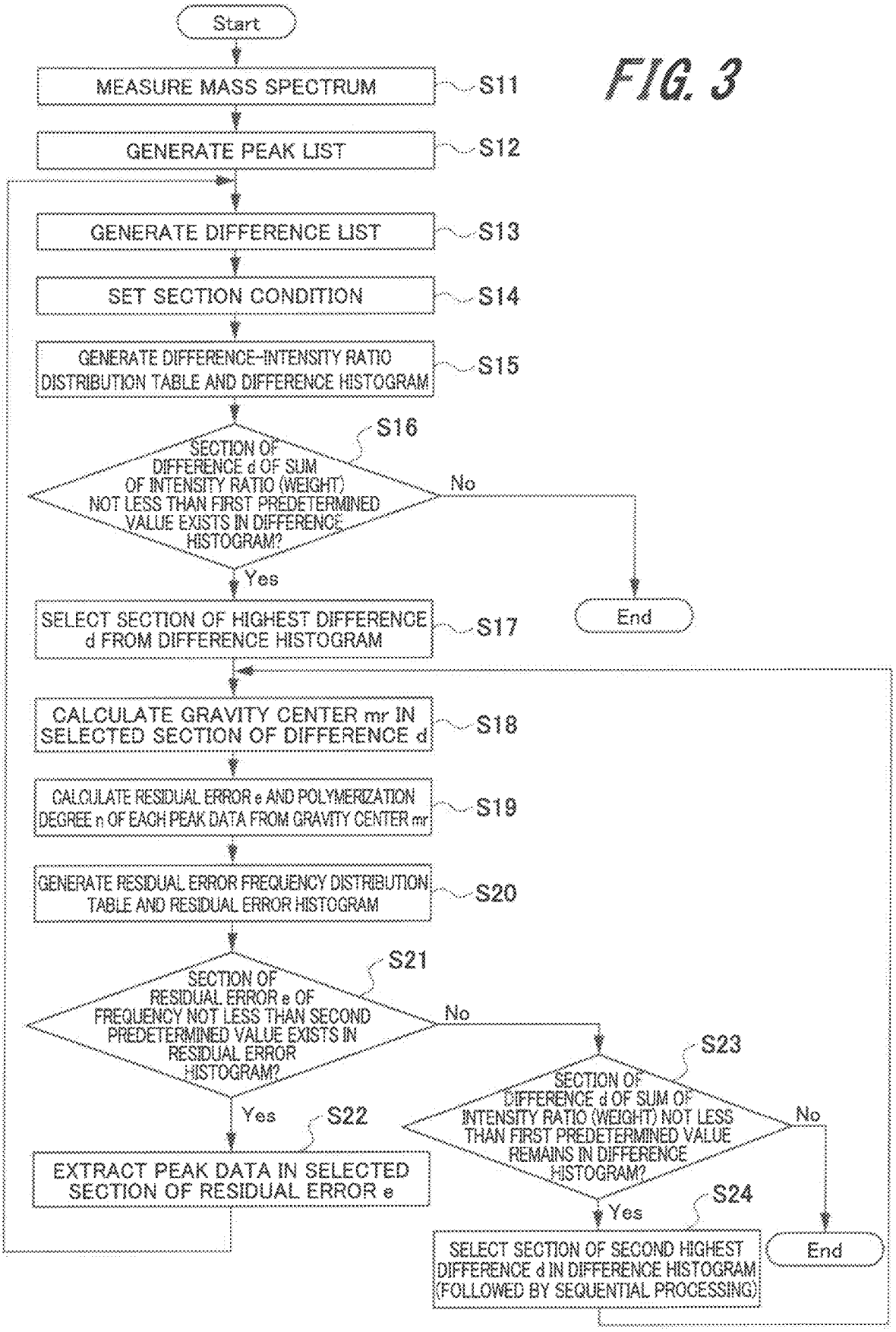
FIG. 3 is a flowchart showing a method for processing mass spectrometry data according to a first embodiment.

FIG. 3 is a flowchart showing a data processing method. In addition, FIG. 4 is data of a sample to be measured in explanation of the data processing method.

Each of a sample A, a sample B, and a sample C shown in FIG. 4 is a polymer having a repeated structure. The samples A and B have the same repeated structure ($C_2H_4O$). The sample C has a repeated structure ($C_3H_6O$) different from that of the samples A and B. In addition, the samples A and B have the different terminal structures (terminal structure of the sample A is $H_2ONa$ and terminal structure of the sample B is $H_2Na$). Note that, the sample C has a terminal structure ($C_2H_4ONa$) different from those of the samples A and B. Here, the data processing method of mass spectrum data of a mixture of the samples A, B, and C will be described.

Figure 5A:
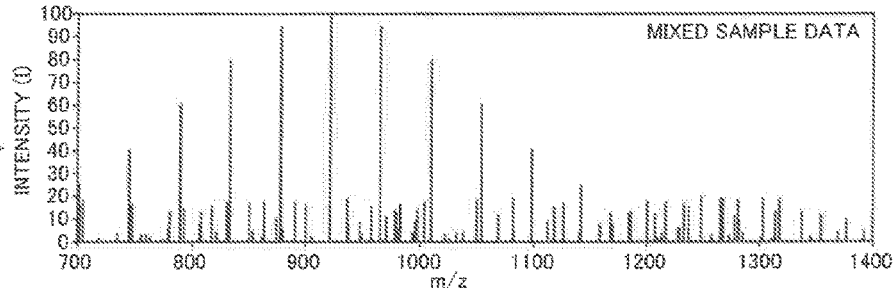
FIGS. 5A to 5E are diagrams showing one example of mass spectrum data used in the method for processing mass spectrometry data according to the first embodiment.
Figure 5B:
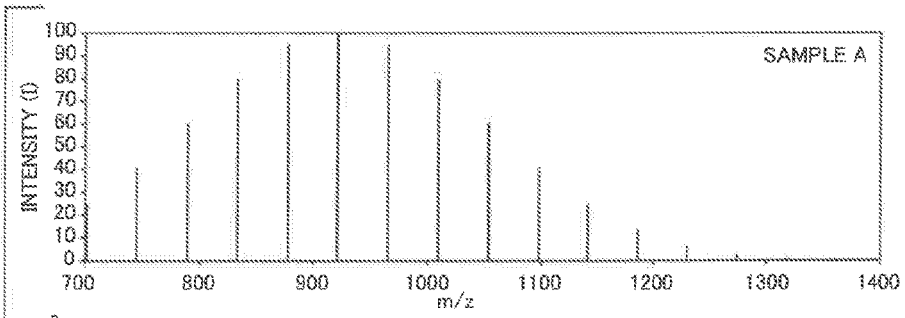
Figure 5C:
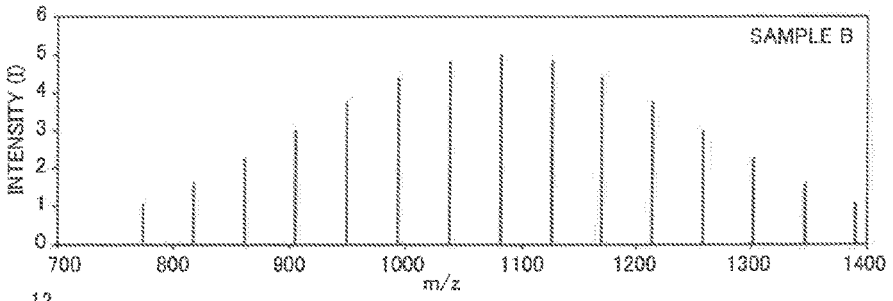
Figure 5D:
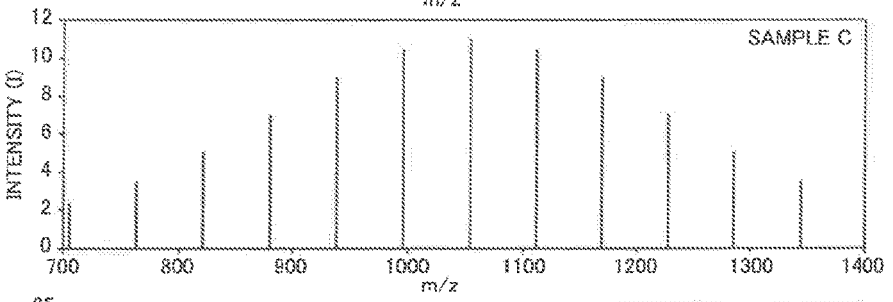
Figure 5E:
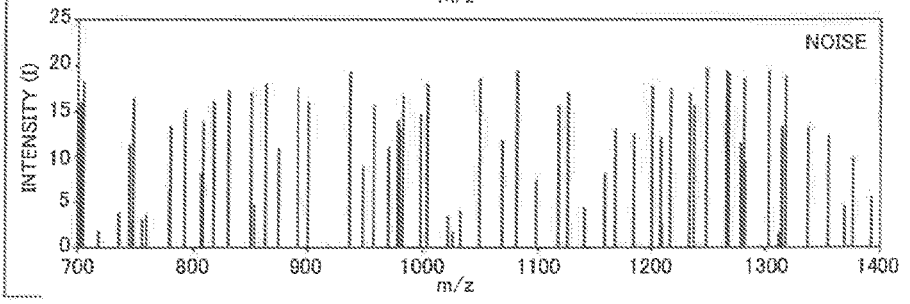

FIG. 5B is mass spectrum data of the sample A, FIG. 5C is mass spectrum data of the sample B, and FIG. 5D is mass spectrum data of the sample C. FIG. 5E is noise data in which peak positions of mass-to-charge ratios (m/z values) are randomly determined. FIG. 5A is, as sample data, mass spectrum data of a mixed sample composed of a mixture of the samples A, B, and C. Note that, the mass spectrum data of the mixed sample shown in FIG. 5A includes noise data shown in FIG. 5E.

Each of FIGS. 5A to 5E shows an intensity (I) at the vertical axis and a mass-to-charge ratio (m/z value) at the horizontal axis. As the intensity (I), a relative intensity or an absolute intensity may be used. Here, the data processing method using mass spectrum data shown in FIG. 5A which is complex and in which many peaks are observed will be described.

As shown in FIG. 3, first, a user measures a mass spectrum of the introduced sample by using the mass spectrometer (step S11). Next, the take-in part 2*b* of the controller 2 in the mass spectrometry data processing apparatus 10 acquires mass spectrum data shown in FIG. 5A from the mass spectrometer 1.

FIG. 6 is a peak list generated from the mass spectrum data of FIG. 5A.

Next, the data processing part 2*c* of the controller 2 extracts peaks from the acquired mass spectrum data and generates the peak list shown in FIG. 6 (step S12). As shown in FIG. 6, in the peak list, a mass-to-charge ratio (m/z) and an intensity (I) are registered for each peak data. Note that, when the peak list is generated, it is preferable to perform processing of combining peaks of peak data of isotope ions derived from the same composition into one.

Then, the data processing part 2*c* stores the generated peak list in the storage part 3. In addition, the data processing part 2*c* may cause the display device 5 to display the peak list shown in FIG. 6 generated via the display controller 2*d*. This allows the user to visually recognize the peak list of mass spectrum data of the measured mixed sample. Next, the calculation part 11 generates a difference list from the generated peak list (step S13).

Figure 7:
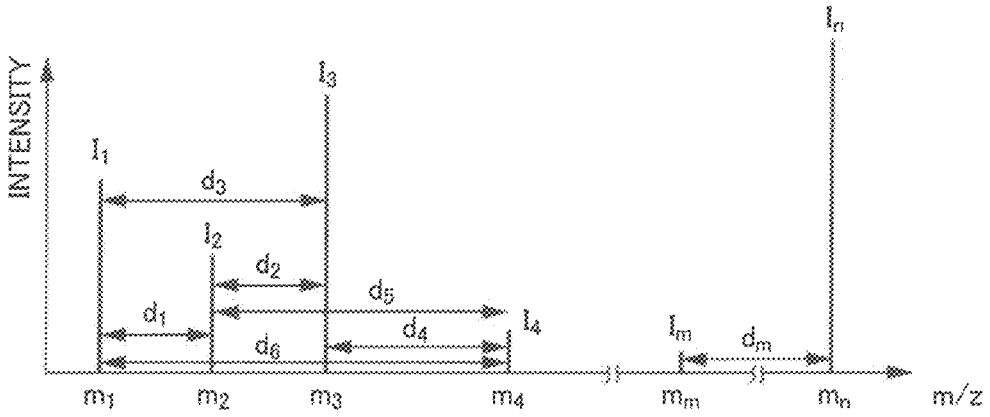
FIG. 7 is an explanatory diagram showing a method for generating a difference list in the method for processing mass spectrometry data according to the first embodiment.

FIG. 7 is an explanatory diagram showing a method for generating a difference list.

As shown in FIG. 7, the calculation part 11 calculates mass-to-charge ratios (m/z values) among all pieces of peak data in the mass spectrum data or the peak list, that is, differences d in mass. For example, in a case where there are n pieces of peak data, the number of calculated differences d is $n(n-1)/2$.

Specifically, the calculation part 11 performs processing described below on combinations of all pieces of peak data. First, it calculates a difference d between two mass-to-charge ratios (m/z values) of peak data. It calculates the difference d by subtracting the smaller mass-to-charge ratio from the larger one. Note that, as the difference d, an absolute value of a difference between two mass-to-charge ratios of peak data may be used. Next, it calculates an intensity ratio (weight) y that is a ratio between two intensities (I) of peak data used in calculation of the difference d. It calculates the intensity ratio (weight) y by setting the peak data having a larger intensity (I) of two pieces of the peak data to be a denominator and setting the peak data having a smaller intensity (I) to be a numerator.

Then, the calculation part 11 registers difference-intensity ratio data including the calculated difference d and the intensity ratio (weight) y corresponding to the difference d in the difference list. Thereby, the difference list as shown in FIG. 8 is generated. The calculation part 11 stores the generated difference list in the storage part 3. In addition, the calculation part 11 may cause the display device 5 to display the difference list generated via the display controller 2*d*.

Next, the calculation part 11 sets a section condition used in processing of step S15 described below (step S14). As the section condition, a range in which difference-intensity ratio distribution data described below is generated and a pitch width of a section in the difference-intensity ratio distribution data are set. The range in which the difference-intensity ratio distribution data is generated is set to a range that includes a mass-to-charge ratio (m/z value) of a composition assumed as a repeated structure of a sample to be analyzed, that is, an exact mass assumed to have a repeated structure. The pitch width of a section is set to a value larger than a mass accuracy when the composition is estimated, a mass accuracy of a repeated structure to be analyzed, or the like.

For example, in a case where the mass of the repeated structure is assumed to be 44, the range in which the difference-intensity ratio distribution data is generated is set to 20 to 60. In addition, if the required mass accuracy is 0.005 u, the pitch width of a section is set to 0.01 u.

Note that, only the pitch width of a section is set and the range in which the difference-intensity ratio distribution data is generated may not be set. However, by preliminarily setting the range in which the difference-intensity ratio distribution data is generated, it is possible to simplify the calculation processing and exclude difference-intensity ratio data of isotope ions. In addition, the section condition of step S14 may be set in the calculation part 11 of the mass spectrometry data processing apparatus 10 or may be input into the mass spectrometry data processing apparatus 10 by the user via the input part 4.

Next, the calculation part 11, based on the section condition set by the processing of step S14, generates a difference-intensity ratio distribution table and a difference histogram (step S15). Specifically, the calculation part 11, based on the set condition, retrieves difference-intensity ratio data having a difference d included in each section from the difference list shown in FIG. 8. Then, the calculation part 11 calculates a sum of all the intensity ratios (weights) y of the retrieved difference-intensity ratio data having the difference d included in each section. For example, in a case where a plurality of pieces of difference-intensity ratio data correspond to the difference-intensity ratio data having the difference d included in a certain section, the calculation part adds the intensity ratios (weights) y of all the corresponding pieces of difference-intensity ratio data to calculate the sum. Thereby, the calculation part 11 calculates difference-intensity ratio distribution data including a section of difference d and a sum of the intensity ratio (weight) y of each section.

In addition, by using the difference-intensity ratio distribution data calculated by the calculation part 11, it is possible to easily perform analysis processing described below and perform analysis or the like of a repeated structure and a terminal structure of a specific sample from complex mass spectrum data in which many peaks are observed.

Figure 10:
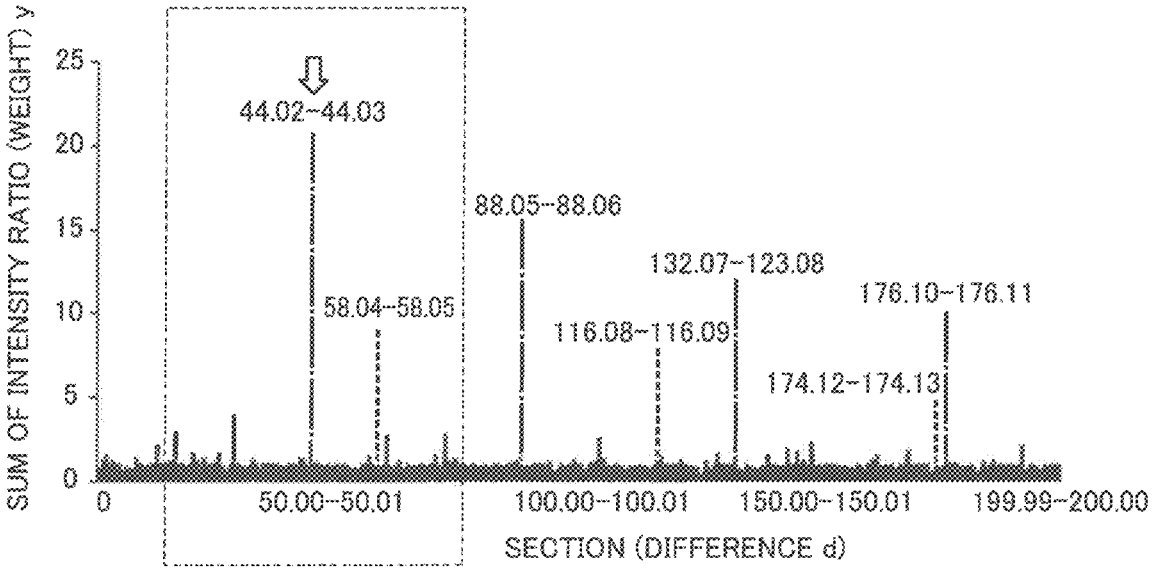
FIG. 10 is a difference histogram generated at the first time in the method for processing mass spectrometry data according to the first embodiment.

Next, the calculation part 11, based on the calculated difference-intensity ratio distribution data, generates a difference-intensity ratio distribution table as shown in FIG. 9 and a difference histogram as shown in FIG. 10. In the difference histogram shown in FIG. 10, the vertical axis shows a sum of the intensity ratio (weight) y and the horizontal axis shows a distribution of the difference d. In addition, the difference histogram shown in FIG. 11 is obtained by extracting the range set in step S14 from the difference histogram shown in FIG. 10.

Figure 11:
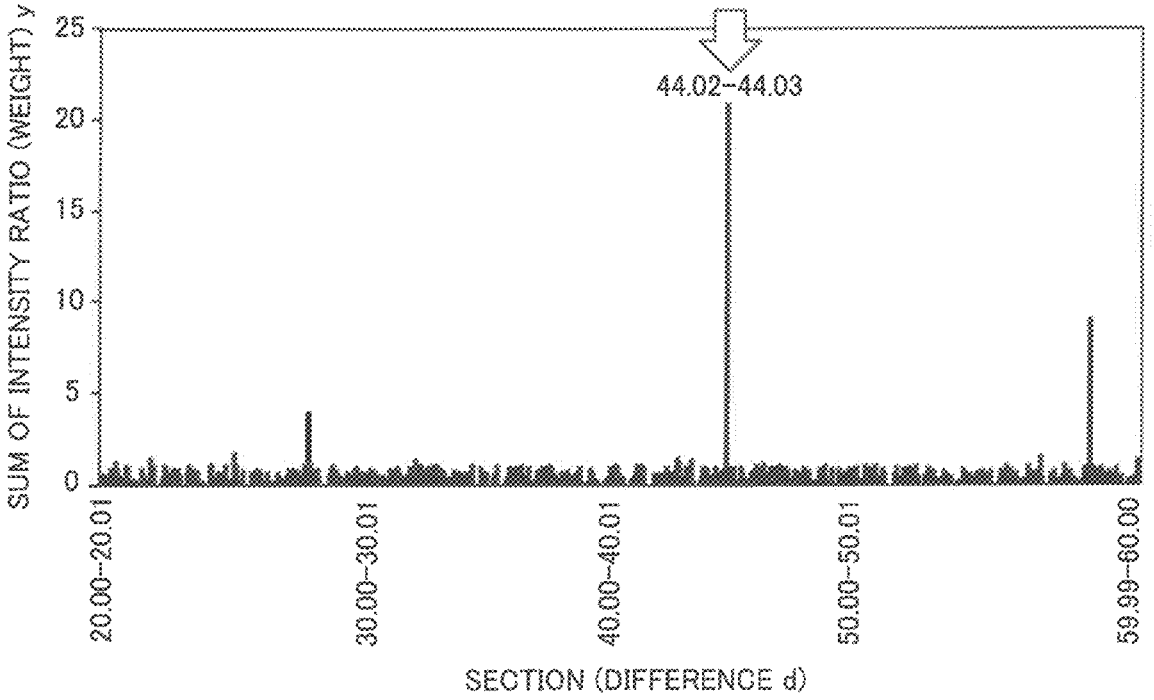
FIG. 11 is a difference histogram showing a part of the difference histogram in FIG. 10 in an enlarged manner.

Then, the calculation part 11 stores, in the storage part 3, the calculated difference-intensity ratio distribution data, the difference-intensity ratio distribution table shown in FIG. 9, and the difference histogram shown in FIGS. 10 and 11. In addition, the data processing part 2*c* may cause the display device 5 to display the generated difference-intensity ratio distribution table and difference histogram via the display controller 2*d*. This allows the user to analyze the repeated structure of the sample from the difference-intensity ratio distribution table and difference histogram displayed on the display device 5.

Next, the calculation part 11 determines whether the section of difference d having the sum of intensity ratio (weight) y not less than a preset first predetermined value exists from the difference-intensity ratio distribution table or difference histogram (step S16). In a case where the calculation part 11 has determined, in the processing of step S16, that the section of difference d having the sum of the intensity ratio not less than the first predetermined value does not exist (NO determination in step S16), the mass spectrometry data processing apparatus 10 determines that a target to be selected does not exist in the generated difference histogram and terminates the data processing operation.

In contrast to this, in a case where the calculation part 11 has determined, in the processing of step S16, that the section of difference d having the sum of the intensity ratio (weight) y not less than the first predetermined value exists (YES determination in step S16), the calculation part 11 selects the section of difference d having the highest sum of the intensity ratio (weight) y (step S17). For example, in the difference histogram shown in FIGS. 10 and 11, the section of 44.02 to 44.03 is selected. Note that, mass of the repeated structure is included in the section of difference d selected in the processing of step S17.

In addition, the processing of step S16 and the processing of step S17 may be performed by the user by use of the difference-intensity ratio distribution table and difference histogram displayed on the display device 5. Alternatively, the calculation part 11 may perform the processing of step S16 and the processing of step S17 from the calculated difference-intensity ratio distribution data.

Here, in a case where two pieces of peak data having the same degree of intensity (I) exist on the acquired mass spectrum data, there is a case where although the number (appearance frequency) of pieces of difference-intensity ratio data in a certain section of difference d is one, the sum of the intensity ratio (weight) y in the difference-intensity ratio distribution data is high. As a result, in the processing of step S17, there is a case where the calculation part 11 selects the section of difference d in which the number (appearance frequency) of pieces of difference-intensity ratio data of the difference d is only one.

To avoid such a problem, the calculation part 11, when calculating the difference-intensity ratio distribution data, may not only sum up the intensity ratio (weight) y of the difference-intensity ratio data in the section but also count the number (appearance frequency) of pieces of difference-intensity ratio data existing in each section. Then, data of the section in which the appearance frequency of pieces of difference-intensity ratio data existing in the section is not more than a predetermined number is excluded. Thereby, in the processing of step S17, a problem of selecting the section in which the number (appearance frequency) of pieces of difference-intensity ratio data is small can be avoided and the calculation part 11 can accurately select the section of difference d in which mass of the repeated structure is included.

Next, the calculation part 11 uses the intensity ratio (weight) y of the corresponding difference-intensity ratio data as weighting with respect to all the differences d of the difference-intensity ratio data corresponding to the selected section to calculate a gravity center mr in the selected section of difference d (step S18). The calculated gravity center mr is a mass of the repeated structure. This makes it possible to accurately analyze a mass of the repeated structure from the complex mass spectrum data in which many peaks are observed.

Note that, the user can also calculate the gravity center mr in the processing of step S18 by using the difference-intensity ratio distribution table and difference histogram displayed on the display device 5.

Next, the calculation part 11 calculates residual errors e and polymerization degrees (number of repeated structures) n of all pieces of peak data from the calculated gravity center (mass of repeated structure) mr (step S19). Here, the residual error e and the polymerization degree n are calculated from the following formulae, wherein the mass-to-charge ratio and the gravity center of each peak data are denoted by m and mr, respectively. Note that, the polymerization degree n is an integer satisfying the following formulae.

$$e=m-n\cdot mr$$

$$n\cdot mr<m<(n+1)\cdot mr \qquad \text{[Formulae]}$$

The calculation part 11 stores the residual error e and polymerization degree n of each peak data calculated in the processing of step S19 in the storage part 3, and adds and registers the residual error e and polymerization degree n to the corresponding peak data in the peak list shown in FIG. 6. Thereby, as shown in FIG. 12, the peak list in which the residual error e and polymerization degree n are added to the peak data can be generated. In addition, the calculation part 11 may cause the display device 5 to display the peak list in which the residual error e and polymerization degree n are added to each peak data shown in FIG. 12 via the display controller 2*d*.

Next, the calculation part 11 calculates residual error frequency distribution data by using the residual error e of each peak data calculated in the processing of step S19 and generates the residual error frequency distribution table and residual error histogram (step S20). First, the calculation part 11 sets a range in which the residual error frequency distribution data is generated and a pitch width of a section of residual error e in the residual error frequency distribution data. The range in which the residual error frequency distribution data is generated is from zero to the gravity center mr. In addition, the pitch width of a section of residual error e is, as with the difference histogram, set to a value larger than the required mass accuracy. For example, if the required mass accuracy is 0.005 u, the pitch width of a section is set to 0.01 u.

Then, the calculation part 11, based on the set range and pitch width of a section, retrieves peak data having the residual error e included in each section of residual error e from the peak list shown in FIG. 12. Next, the calculation part counts a number (appearance frequency) of pieces of the retrieved peak data having the residual error e included in each section. The number (appearance frequency) of pieces of the peak data is a frequency. Thereby, the residual error frequency distribution data is calculated by the calculation part 11.

Figure 14:
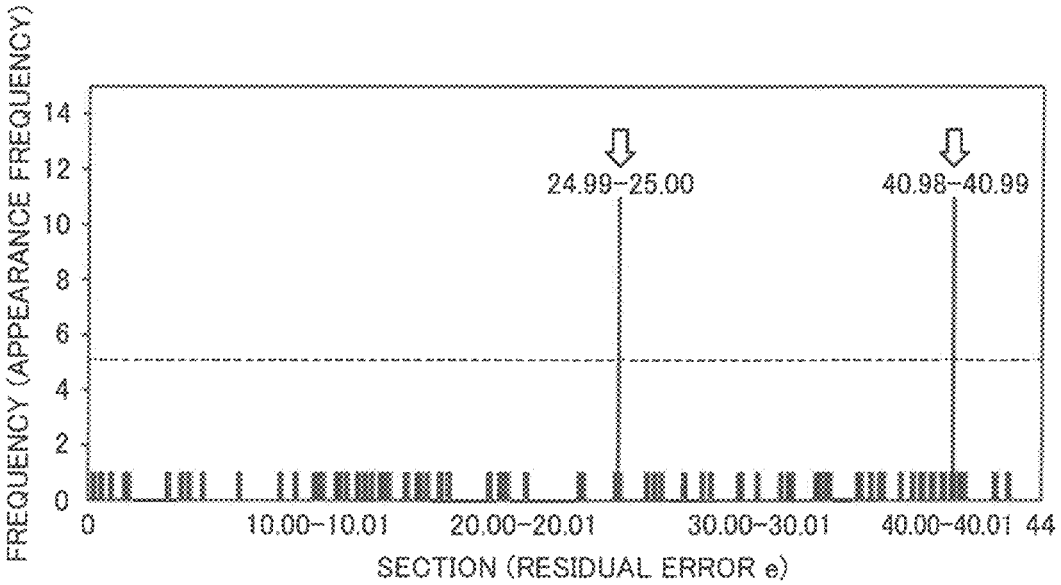
FIG. 14 is a residual error histogram generated at the first time in the method for processing mass spectrometry data according to the first embodiment.

Next, the calculation part 11, based on the calculated residual error frequency distribution data, generates the residual error frequency distribution table shown in FIG. 13 and residual error histogram shown in FIG. 14. In the residual error histogram shown in FIG. 14, the vertical axis shows a frequency (appearance frequency) and the horizontal axis shows a distribution of the residual error e.

Then, the calculation part 11 stores, in the storage part 3, the calculated residual error frequency distribution data, the residual error frequency distribution table shown in FIG. 13, and the residual error histogram shown in FIG. 14. In addition, the data processing part 2*c* causes the display device 5 to display the generated residual error frequency distribution table and residual error histogram via the display controller 2*d*. This enables the user to analyze the terminal structure of the sample from the residual error frequency distribution table and residual error histogram displayed on the display device 5.

Next, the calculation part 11 determines whether the section of residual error e having the frequency (appearance frequency) not less than a preset second predetermined value exists from the residual error frequency distribution table or residual error histogram (step S21). The second predetermined value is set based on the distribution of polymerization degree assumed in the sample to be analyzed. For example, in a case of a sample assumed to have a wide distribution of polymerization degree, the second predetermined value is increased, and in a case of a sample assumed to have a narrow distribution of polymerization degree, the second predetermined value is decreased.

Note that, the calculation part 11 may perform the processing of step S21 by using the calculated residual error frequency distribution data.

In a case where the calculation part 11 has determined, in the processing of step S21, that the section of residual error e having the frequency (appearance frequency) not less than the second predetermined value does not exist (NO determination in step S21), the calculation part 11 determines whether the section of difference d having the sum of intensity ratio (weight) y not less than the first predetermined value remains in other than the section of difference d selected in step S17 from the difference histogram (step S23). In a case where the calculation part 11 has determined, in the processing of step S23, that the section of difference d having the sum of intensity ratio not less than the first predetermined value does not exist (NO determination in step S23), the mass spectrometry data processing apparatus 10 determines that a target to be selected does not exist in the generated difference list and terminates the data processing operation.

In addition, in a case where the calculation part 11 has determined, in the processing of step S23, that the section of difference d having the sum of intensity ratio (weight) y not less than the first predetermined value remains (YES determination in step S23), the calculation part 11 selects the section of difference d in which the sum of intensity ratio (weight) y is the second highest (step S24). Then, in the processing of step S24, if the calculation part 11 selects the section of difference d in which the sum of intensity ratio (weight) y is the second highest, the data processing part 2*c* returns to the processing of step S18.

In addition, in a case where the calculation part 11 has determined, in the processing of step S21, that the section of residual error e having the frequency (appearance frequency) not less than the second predetermined value exists (YES determination in step S21), the calculation part 11 extracts the peak data corresponding to the section from the peak list shown in FIG. 12 (step S22). In the residual error histogram shown in FIG. 14, the section of 24.99 to 25.00 and the section of 40.98 to 40.99 are selected and the peak data corresponding to these sections are extracted, respectively.

In addition, the calculation part 11, when extracting the peak data, may determine continuity of the polymerization degree n by using the polymerization degree n registered in each peak data. For example, the extracted peak data, the polymerization degree n of which is separated by three or more with respect to the polymerization degree n of the other extracted peak data, can be determined not to be continuous. Then, the calculation part 11 does not extract the corresponding peak data. Specifically, in a case where the polymerization degrees n corresponding to the selected section are n=1, 8, 9, 11, 12, respectively, the peak data having the polymerization degree n=1, because the polymerization degree n is separated by three or more with respect to the polymerization degrees n of the other peak data, is determined not to be continuous and is not extracted by the calculation part 11.

The data processing part 2*c* groups and manages the extracted peak data for each of the corresponding gravity centers (mass of the repeated structure) mr or sections of the residual error e. Each group can be grasped as an aggregate of peak data of the sample having the same repeated structure and terminal structure.

Next, the calculation part 11 weights the intensity (I) with respect to the residual errors e of all pieces of peak data existing in each group to calculate the gravity center me of the residual errors e in the group. The calculated gravity center me of the residual errors e is a mass of the terminal structure of the sample corresponding to the group. This makes it possible to calculate an accurate mass of the terminal structure of each group, that is, a specific sample.

In addition, the data processing part 2*c* can also estimate a composition for each group by using the gravity center (mass of the repeated structure) mr and the gravity center (mass of the terminal structure) me. Here, in a case where the calculated mass me of the terminal structure is too small as an assumed molecular weight, for example, less than 10, it is possible to estimate the composition by appropriately adding the mass mr of the repeated structure to the gravity center me. Further, an average molecular weight or a dispersion degree of each group can be calculated by the calculation part 11.

FIG. 15A is a peak list obtained by extracting peak data in which the section of residual error e selected in the processing of step S22 corresponds to 40.98 to 40.99, and FIG. 15B is a peak list obtained by extracting peak data in which the section of residual error e selected in the processing of step S22 corresponds to 24.99 to 25.00.

It can be analyzed from the peak list shown in FIG. 15A that the residual error e, that is, the range of the mass of the terminal structure is 40.98 to 40.99, and the mass of the repeated structure is 44. Further, the intensity (I) of each peak data is not more than 100, and the polymerization degree n is 15 to 29. Therefore, the extracted peak list shown in FIG. 15A can be determined to be a peak list corresponding to the sample A shown in FIG. 4.

In addition, it can be analyzed from the peak list shown in FIG. 15B that the residual error e, that is, the range of the mass of the terminal structure is 24.99 to 25.00, and the mass of the repeated structure is 44. Further, the intensity (I) of each peak data is not more than 5, and the polymerization degree n is 17 to 31. Therefore, the extracted peak list shown in FIG. 15B can be determined to be a peak list corresponding to the sample B shown in FIG. 4.

In addition, the data processing part 2*c* may cause the display device 5 to display the peak lists shown in FIGS. 15A and 15B via the display controller 2*d*. This allows the user to easily analyze each sample by use of the peak lists shown in FIGS. 15A and 15B displayed on the display device 5.

Next, the data processing part 2*c* excludes the peak data extracted in the processing of step S22 from the peak list shown in FIG. 6 and returns to the processing of step S13. Then, the calculation part 11 generates the difference list by using the peak list from which the peak data extracted in the processing of step S22 has been excluded (step S13). The calculation part 11 sets the section condition again (step S14) from the generated difference list, and also calculates the difference-intensity ratio distribution data and generates the difference histogram and the difference-intensity ratio distribution table (step S15).

Figure 16:
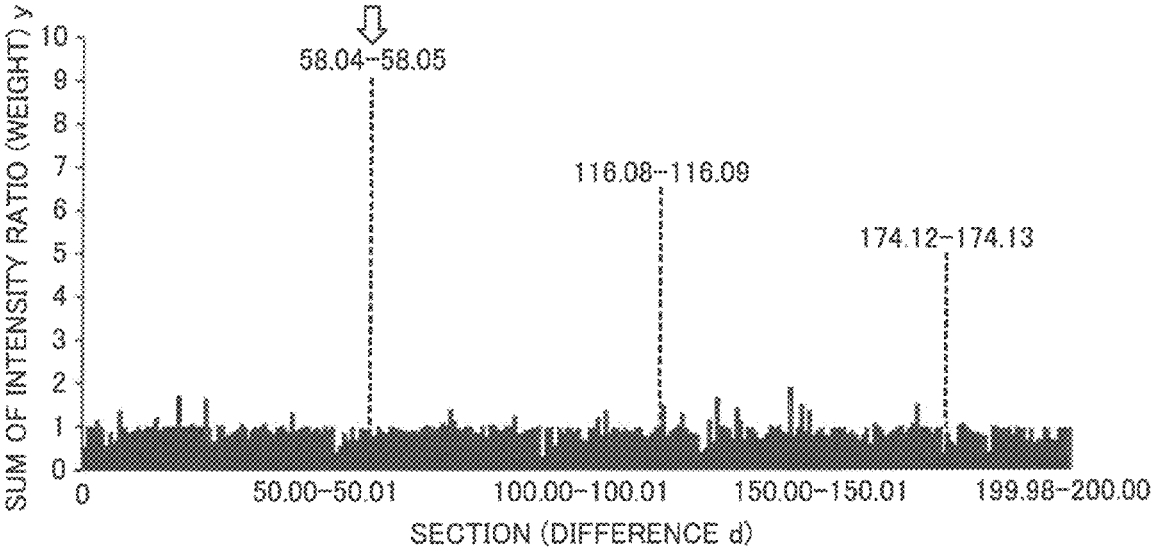
FIG. 16 is a difference histogram generated at the second time in the method for processing mass spectrometry data according to the first embodiment.

FIG. 16 is a difference histogram generated by using the peak list from which the peak data extracted in the processing of step S22 has been excluded. In the difference histogram shown in FIG. 16, the section of 58.04 to 58.05 is selected (step S17). Then, the calculation part 11 uses the intensity ratio (weight) y as weighting with respect to the difference d of the difference-intensity ratio data corresponding to the selected section of difference d to calculate a gravity center in the selected section of difference d, that is, the mass of the repeated structure (step S18).

Then, the calculation part 11 calculates, from the calculated gravity center, the residual error e and the polymerization degree n of all pieces of peak data in the peak list from which the peak data extracted in the processing of step S22 has been excluded (step S19). Then, the calculation part 11 calculates the residual error frequency distribution data again by using the calculated residual error e of each peak data and generates the residual error frequency distribution table and residual error histogram (step S20).

Figure 17:
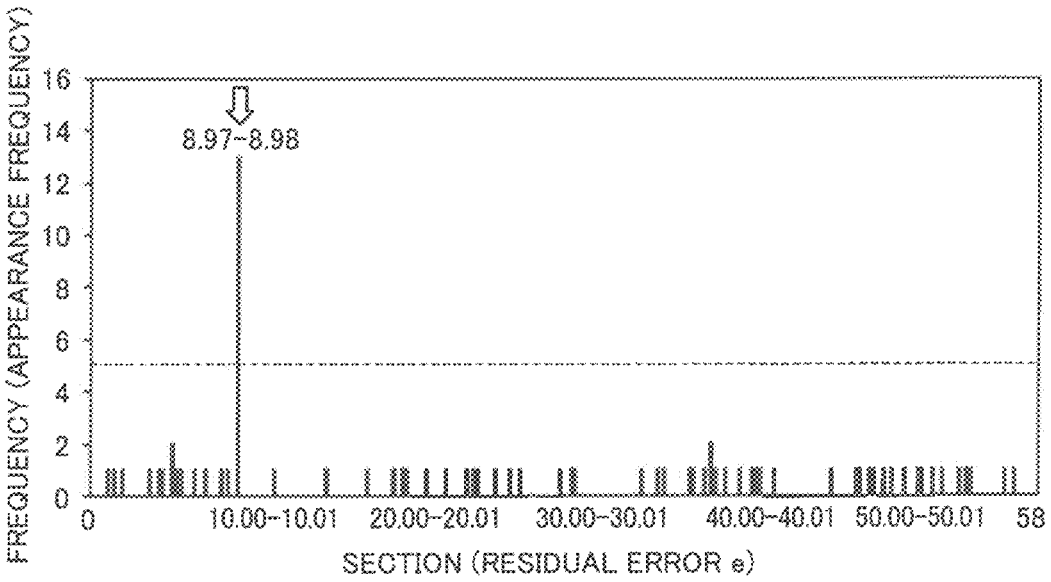
FIG. 17 is a residual error histogram generated at the second time in the method for processing mass spectrometry data according to the first embodiment.

FIG. 17 is the residual error histogram generated from the residual error frequency distribution data calculated based on the peak list from which the peak data extracted in the processing of step S22 has been excluded. In the residual error histogram shown in FIG. 17, the section of residual error e of 8.97 to 8.98 is selected and the peak data corresponding to this section is extracted (step S21, step S22).

FIG. 18 is a peak list obtained by extracting the peak data corresponding to the section of residual error e selected in FIG. 17. It can be analyzed from the peak list shown in FIG. 18 that the residual error e, that is, the range of the mass of the terminal structure is 8.97 to 8.98, and the mass of the repeated structure is 58. Further, the intensity (I) of each peak data is not more than 10, and the polymerization degree n is 12 to 24. Note that, the range of the calculated residual error e is 8.97 to 8.98, which is a small number not more than 10, and thus the mass of the repeated structure is added to the residual error e to give 66.97 to 66.98. Therefore, the extracted peak list shown in FIG. 18 can be determined to be a peak list corresponding to the sample C shown in FIG. 4.

Thus, according to the data processing method of the present example, it is possible to easily extract a peak list of each of the sample A, the sample B, and the sample C from the mass spectrum data of the mixture in which three samples A, B, and C are mixed shown in FIG. 5A, and the respective repeated structures and terminal structures can be analyzed.

In addition, after step S22 is finished again, the data processing part 2*c* excludes the peak data extracted in the processing of step S22 from the peak list shown in FIG. 6 and returns to the processing of step S13. Then, the calculation part 11 generates the difference list by using the peak list from which the peak data extracted in the processing of step S22 has been excluded, and generates the difference histogram.

Figure 19:
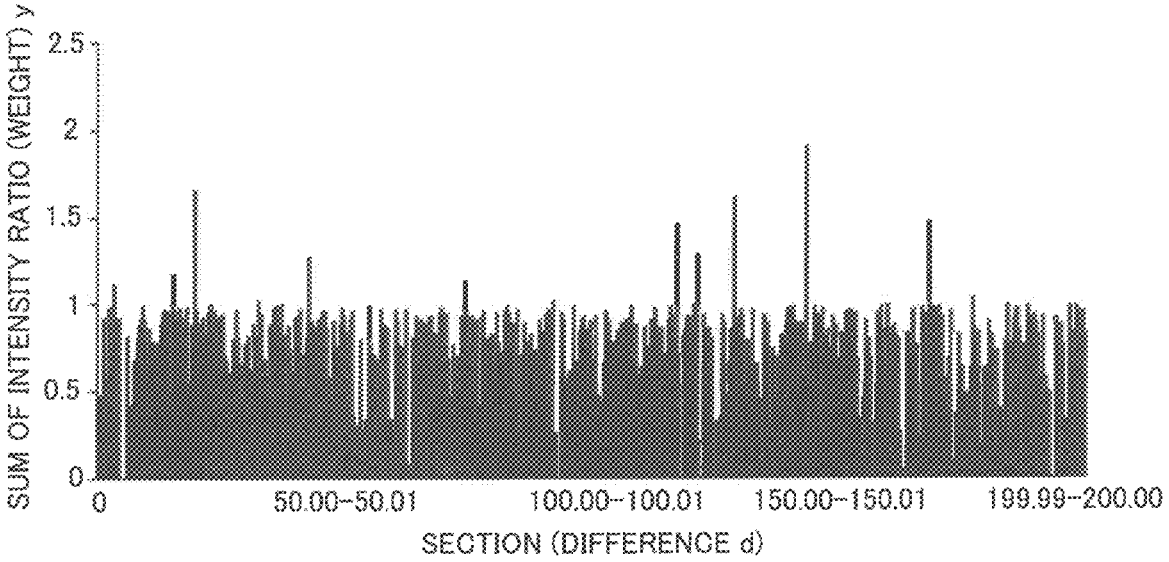
FIG. 19 is a difference histogram generated at the third time in the method for processing mass spectrometry data according to the first embodiment.

FIG. 19 is a difference histogram generated with the peak list of the remaining peak data. In the difference histogram shown in FIG. 19, the section of difference d having the sum of the intensity ratio not less than the first predetermined value does not exist. Therefore, the calculation part 11 determines that a target to be selected does not exist in the generated difference histogram (NO determination in step S16). With such a process flow, the mass spectrometry data processing apparatus 10 terminates the data processing operation.

3. Method for Processing Mass Spectrometry Data According to a Second Embodiment Next, a method for processing mass spectrometry data according to a second embodiment will be described with reference to FIG. 20.

Figure 20:
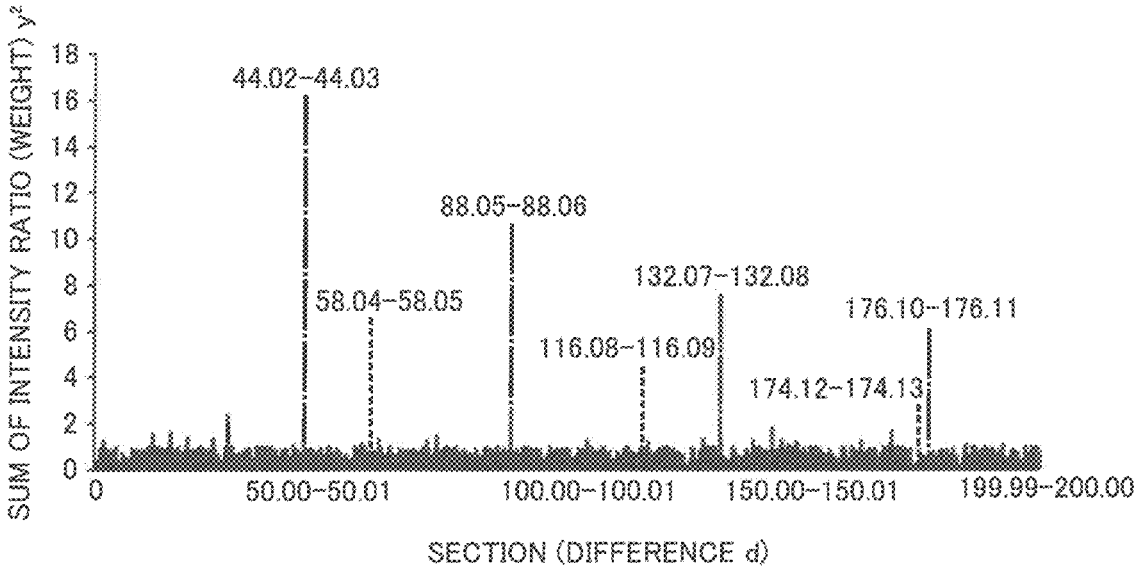
FIG. 20 is a difference histogram in the method for processing mass spectrometry data according to a second embodiment.

FIG. 20 is a difference histogram according to the second embodiment.

In the method for processing mass spectrometry data according to the first embodiment, when the difference-intensity ratio distribution data is calculated, the sum of the intensity ratio (weight) y of the difference-intensity ratio data corresponding to a certain section of difference d is calculated. In contrast to this, in the method for processing mass spectrometry data according to the second embodiment, when the difference-intensity ratio distribution data is calculated, a squared value of the intensity ratio (weight) y of the difference-intensity ratio data corresponding to a certain section of difference d is summed up. Note that, the processing of squaring the intensity ratio (weight) y may be performed in calculating the difference-intensity ratio distribution data or performed in generating the difference-intensity ratio data, that is, the difference list.

As shown in FIG. 20, this increases a difference between the sums of the intensity ratio (weight) y in each section of difference d when the difference histogram is generated. Consequently, in the above-described processing of step S16 and step S17, processing of selecting the section of difference d can be performed accurately.

Note that, in the method for processing mass spectrometry data according to the second embodiment, the example of squaring the intensity ratio (weight) y is described, but an exponent for raising the intensity ratio (weight) y is not limited to two but is set optionally.

Other configurations and processing methods are similar to the method for processing mass spectrometry data according to the first embodiment, and thus the description thereof is omitted. Also, with the method for processing mass spectrometry data having such a configuration and processing, it is possible to obtain a working effect similar to that of the method for processing mass spectrometry data according to the first embodiment.

4. Method for Processing Mass Spectrometry Data According to a Third Embodiment

Next, a method for processing mass spectrometry data according to a third embodiment will be described with reference to FIGS. 21A to 21C and FIGS. 22A to 22C.

Figure 21A:
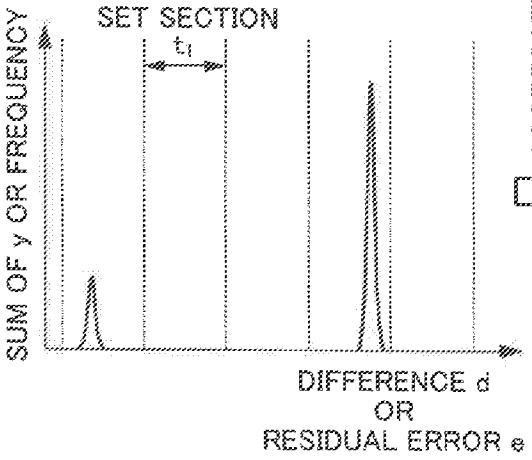
FIGS. 21A to 21C are explanatory diagrams each showing a difference histogram and a residual error histogram of the method for processing mass spectrometry data according to the first embodiment.
Figure 21B:
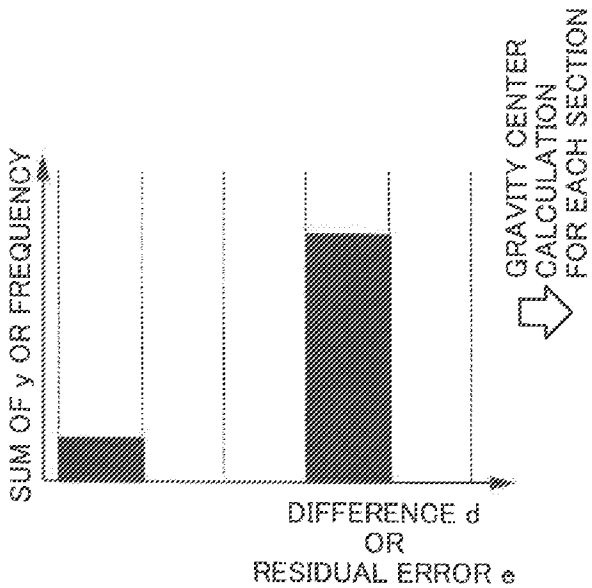
Figure 21C:
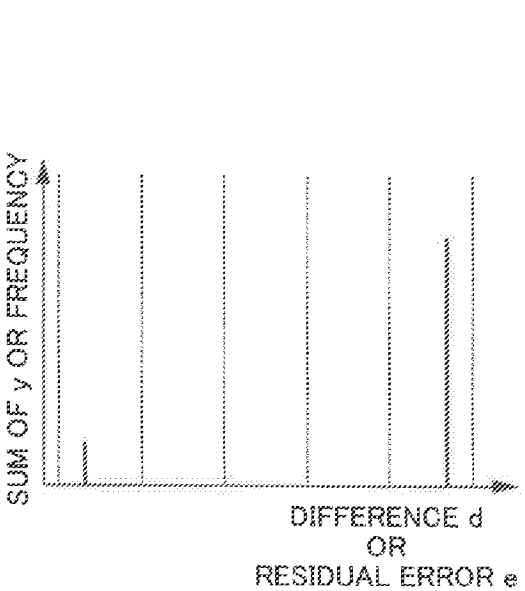
Figure 22A:
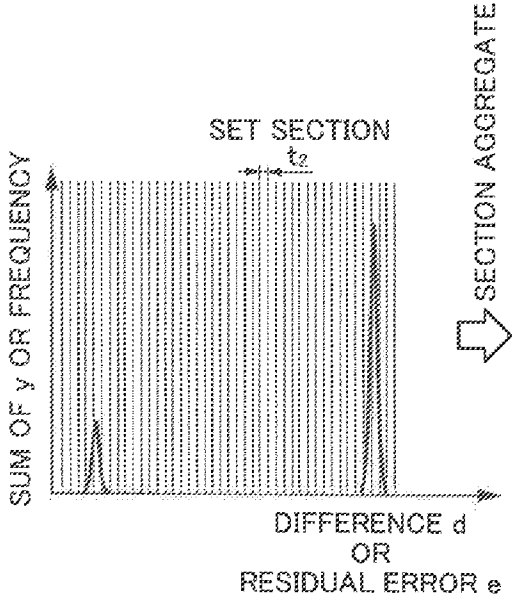
FIGS. 22A to 22C are explanatory diagrams each showing a difference histogram and a residual error histogram of the method for processing mass spectrometry data according to a third embodiment.
Figure 22B:
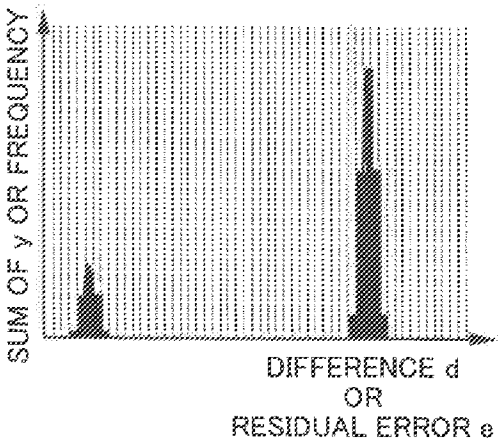
Figure 22C:
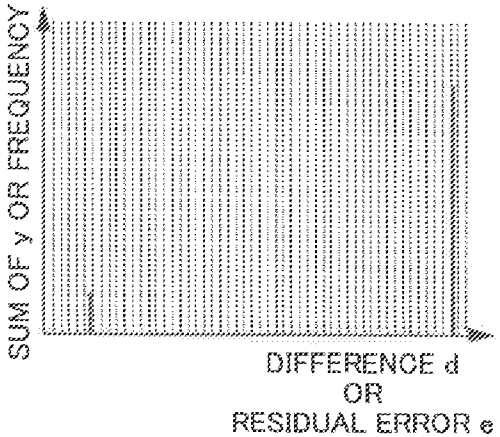
Figure 23A:
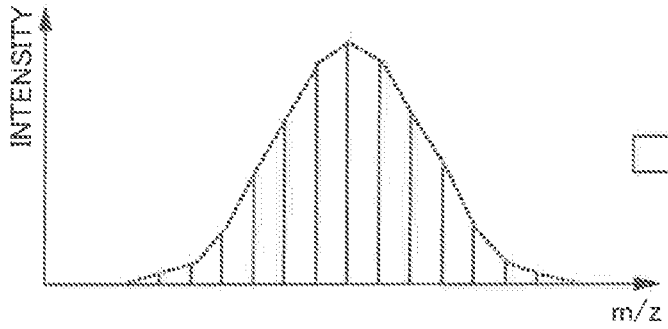
FIGS. 23A and 23B are explanatory diagrams showing a conventional method for processing mass spectrometry data.
Figure 23B:
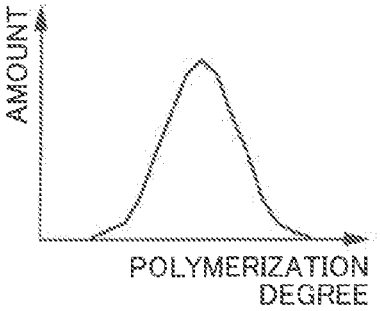

FIGS. 21A to 21C are explanatory diagrams each showing a difference histogram and a residual error histogram according to the first embodiment, and FIGS. 22A to 22C are explanatory diagrams each showing a difference histogram and a residual error histogram according to the third embodiment.

In the method for processing mass spectrometry data according to the first embodiment, when the difference-intensity ratio distribution data and the residual error frequency distribution data are calculated, a pitch width t1 of the section of difference d or residual error e is set to a value larger than the mass accuracy. The difference histogram and residual error histogram as shown in FIGS. 21A and 21B are generated from the calculated difference-intensity ratio distribution data and residual error frequency distribution data. In addition, as shown in FIG. 21C, the mass of the repeated structure or terminal structure is calculated by calculation of the gravity center for each section.

In contrast to this, in the method for processing mass spectrometry data according to the third embodiment, when the difference-intensity ratio distribution data and the residual error frequency distribution data are calculated, a pitch width t2 of the section of difference d or residual error e is set to a value smaller than the mass accuracy. For example, if the required mass accuracy is 0.005 u, the pitch width t2 of the section of difference d or residual error e is set to 0.001 u.

Then, the difference histogram and residual error histogram as shown in FIGS. 22A and 22B are generated from the calculated difference-intensity ratio distribution data and residual error frequency distribution data. Then, a peak detection is performed from the difference histogram and residual error histogram shown in FIG. 22B. Thereby, it is possible to generate the difference-intensity ratio distribution data or residual error frequency distribution data in which only the peaks shown in FIG. 22C are detected. Then, the above-described processing of step S17 and step S21 are performed by use of this peak detection, and the mass of the repeated structure or terminal structure is analyzed from the residual error intensity ratio data and peak data.

Other configurations and processing methods are similar to the method for processing mass spectrometry data according to the first embodiment, and thus the description thereof is omitted. Also, with the method for processing mass spectrometry data having such a configuration and processing, it is possible to obtain a working effect similar to that of the method for processing mass spectrometry data according to the first embodiment.

Note that, the present invention is not limited to examples described above and shown in the drawings but can be modified variously and carried out within a scope not deviating from the gist of the invention described in claims.

In the above-described embodiments, the example in which the data processing part 2*c* causes the display device 5 to display the peak list, difference list, difference-intensity ratio distribution table, difference histogram, residual error intensity distribution table, residual error histogram, extracted peak list, or the like is explained, but the embodiment is not limited to this. For example, the mass spectrometry data processing apparatus 10 may be provided with a printing part that prints data processed by the data processing part 2*c* on a sheet. Then, by use of the printing part, the peak list, difference list, difference-intensity ratio distribution table, difference histogram, residual error intensity distribution table, residual error histogram, extracted peak list, or the like may be printed on a sheet.

The mass spectrometry data processing apparatus 10 may be provided with an output part that outputs information to an external portable information terminal or a PC (personal computer). Then, information is output from the output part to the external portable information terminal or PC, and the peak list, difference list, difference-intensity ratio distribution table, difference histogram, residual error intensity distribution table, residual error histogram, extracted peak list, or the like may be displayed on the external portable information terminal or PC, or printed on a sheet by use of the external portable information terminal or PC.

What is claimed is:

1. A mass spectrometry data processing apparatus, comprising a data processing part that extracts a plurality of peaks from mass spectrum data and generates a peak list including peak data in which a mass and an intensity of each of the peaks are registered, wherein the data processing part has a calculation part that calculates differences in mass among all pieces of the peak data from the peak list, and the calculation part calculates an intensity ratio that is a ratio of intensity between two pieces of the peak data used in calculating the difference for each of the calculated differences, generates difference-intensity ratio data including the difference and the intensity ratio, retrieves difference-intensity ratio data having the difference included in a section of a preset difference from the difference-intensity ratio data, calculates a sum of the intensity ratio of the retrieved difference-intensity ratio data, and calculates difference-intensity ratio distribution data including a section of the difference and a sum of the intensity ratio.

2. The mass spectrometry data processing apparatus according to claim 1, wherein the calculation part calculates the intensity ratio by setting peak data having a larger intensity of two pieces of the peak data to be a denominator and setting peak data having a smaller intensity to be a numerator.

3. The mass spectrometry data processing apparatus according to claim 1, wherein the calculation part selects a section of the difference having the highest intensity ratio from the difference-intensity ratio distribution data.

4. The mass spectrometry data processing apparatus according to claim 3, wherein the calculation part weights the intensity ratio corresponding to the difference with respect to the difference of the difference-intensity ratio data within the selected section of the difference, and calculates a gravity center in the selected section of the difference.

5. The mass spectrometry data processing apparatus according to claim 4, wherein the calculation part calculates a residual error of each peak data of the peak list by using the calculated gravity center in the section of the difference.

6. The mass spectrometry data processing apparatus according to claim 5, wherein the calculation part retrieves the peak data having the residual error included in a section of a preset residual error, counts frequencies including the number of pieces of the retrieved peak data, and calculates residual error frequency distribution data.

7. The mass spectrometry data processing apparatus according to claim 6, wherein the calculation part selects a section of the residual error in which the frequency of the peak data is a predetermined value or more from the residual error frequency distribution data, and extracts the peak data in the selected section of the residual error from the peak list.

8. The mass spectrometry data processing apparatus according to claim 7, wherein the data processing part groups the peak data for each of the selected sections of the residual error.

9. The mass spectrometry data processing apparatus according to claim 7, wherein the calculation part weights the intensity corresponding to the residual error with respect to the residual error of the peak data in the selected section of the residual error to calculate a gravity center in the selected section of the residual error.

10. The mass spectrometry data processing apparatus according to claim 7, wherein the data processing part excludes the extracted peak data from the peak list, and the calculation part calculates difference-intensity ratio data and difference-intensity ratio distribution data by using the peak list from which the peak data has been excluded.

11. The mass spectrometry data processing apparatus according to claim 1, wherein the calculation part counts a number of the difference-intensity ratio data existing in the section of the difference in calculating the difference-intensity ratio distribution data, and excludes a section in which the counted number of the difference-intensity ratio data is not more than a predetermined number.

12. The mass spectrometry data processing apparatus according to claim 1, wherein the calculation part generates a histogram on the basis of calculated data.

13. A mass spectrometry system, comprising:

a mass spectrometer that performs mass spectrometry of a sample and generates mass spectrum data; and a mass spectrometry data processing apparatus that acquires the mass spectrum data from the mass spectrometer, wherein the mass spectrometry data processing apparatus includes a data processing part that extracts a plurality of peaks from the mass spectrum data and generates a peak list including peak data in which a mass and an intensity of each of the peaks are registered, the data processing part has a calculation part that calculates differences in mass among all pieces of the peak data from the peak list, and the calculation part calculates an intensity ratio that is a ratio of intensity between two pieces of the peak data used in calculating the difference for each of the calculated differences, generates difference-intensity ratio data including the difference and the intensity ratio, retrieves difference-intensity ratio data having the difference included in a section of a preset difference from the difference-intensity ratio data, calculates a sum of the intensity ratio of the retrieved difference-intensity ratio data, and calculates difference-intensity ratio distribution data including a section of the difference and a sum of the intensity ratio.

14. A method for processing mass spectrometry data, comprising the steps of:

extracting a plurality of peaks from mass spectrum data and generating a peak list including peak data in which a mass and an intensity of each of the peaks are registered;

calculating differences in mass among all pieces of the peak data from the peak list, calculating an intensity ratio that is a ratio of intensity between two pieces of the peak data used in calculating the difference for each of the calculated differences, and generating difference-intensity ratio data including the difference and the intensity ratio; and retrieving difference-intensity ratio data having the difference included in a section of a preset difference from the difference-intensity ratio data, calculating a sum of the intensity ratio of the retrieved difference-intensity ratio data, and calculating difference-intensity ratio distribution data including a section of the difference and a sum of the intensity ratio.

* * * * *